US005579613A

United States Patent [19]

Carr

[11] Patent Number: 5,579,613

[45] Date of Patent: Dec. 3, 1996

[54] MODULAR CLOSURE UNIT

[76] Inventor: Albert E. Carr, 10292 N. 103rd St., Scottsdale, Ariz. 85258

[21] Appl. No.: 301,805

[22] Filed: Sep. 7, 1994

[51] Int. Cl.[6] ..... E04H 1/00

[52] U.S. Cl. ..... 52/79.1; 312/242; 312/329

[58] Field of Search ..... 52/79.1, 79.11; 312/242, 245, 329; 1/79.7.79.12

[56] References Cited

U.S. PATENT DOCUMENTS

| | | | |
|---|---|---|---|
| Re. 31,409 | 10/1983 | Crist | 312/242 |
| 1,600,017 | 9/1926 | Simonson | 52/79.1 X |
| 4,998,388 | 3/1991 | Englehart | 52/79.1 X |

*Primary Examiner*—Carl D. Friedman
*Assistant Examiner*—W. Glenn Edwards
*Attorney, Agent, or Firm*—Richard R. Mybeck; Peter B. Scull

[57] ABSTRACT

A modular closure unit is described which has three walls, two of which are side walls each connected to the opposite vertical edges of the third or back wall. A top member is also integrally attached to the top edges of all three walls. Two discrete attachment means detachably attach the unit to the doorframe of an existing doorway in a wall to thereby close the doorway and prevent the unilateral removal of the unit by persons having access to only one side of the unit. The unit permits operable retention of the previously mounted door when desired.

18 Claims, 3 Drawing Sheets

MODULAR CLOSURE UNIT

The present invention relates generally to a modular doorway closure unit and more specifically a removable three-sided, closure-top closet-type unit which is detachably attachable to a doorframe which defines a doorway, or like opening in a wall, to securely close off the opening.

BACKGROUND OF THE INVENTION

In the world of commercial real estate, one or more rental spaces may be designed to occupy a single floor plan containing a plurality of separate, adjacent rooms. Subsequently, the configuration of rental spaces may be altered by either subdividing a single space into multiple adjacent spaces or by combining several adjacent spaces to create a singular enlarged rental space.

A common method for subdividing or enlarging rental spaces entails either cutting in and installing new doorways, or closing or filling-in existing doorways in the building walls separating the various rooms. To subdivide a large space, the doorways between adjacent rooms are preferably sealed off by installing dry wall or the like to fill in the doorway to create a continuous solid wall. Alternatively, to combine adjacent rooms into a common rental space, a doorway is formed in an existing wall by removing selective portions of the wall to create an opening, framing the opening thus created, and installing a door to the frame. It is, of course, possible and indeed, a common practice, to later reseal a doorway thus created to re-subdivide the adjacent spaces into a different configuration.

The current practice for closing off an existing doorway involves first, the removal of the door, and its associated doorframe and moldings to leave an opening. Then, the door opening is physically filled in with suitable wall materials including for example, studs and dry wall, or concrete or cinder blocks and the like to reconstruct the wall. Thereafter, the now continuous wall is wallpapered, taped, textured and painted on both sides and a baseboard installed. Obviously, the reverse process is used to open a doorway at this or any other location in the wall. Specifically, the wall is first cut through in the desired size and shape of the doorway to be formed. Then, the wall material is removed and the appropriate doorframes, moldings and doors (as desired) are attached.

Though the heightened security provided by the aforesaid practice of constructing new walls to fill in door openings is of paramount importance, there are still further reasons that these methods are preferable to the mere closing and locking of an existing door between adjacent spaces. For example, the closed off, continuous wall also provides a sound deadening effect and increases the fire retardance between the two spaces. Furthermore, an uninterrupted solid wall has a more pleasing, professional appearance than does a non-functioning locked door. Such an appearance further contributes to a beneficial feeling of permanence for the tenant which affects not only goodwill but ultimately positively contributes also to the marketability of the rental spaces.

However, considerable disadvantages also accompany the use of these above-described procedures. For example, the process of ripping out walls to create doorways and the reestablishment of walls in once opened doorways is expensive, messy and time-consuming during which time the lessor is not receiving rent. Other than the time, materials and effort required to erect and close off a wall or vice versa, to tear one down and, in lieu thereof, install all the necessary doorway hardware including doorframes, doors and moldings, etc; further mess and expense are also usually encountered due to finishing requirements such as painting or otherwise resurfacing both sides of the entire wall. These construction efforts may also impinge on the adjacent ceilings and floors and thereby cause further and potentially different resurfacing challenges. Additionally, the damage often done to the floor, frequently necessitates re-carpeting significant portions, if not all of the newly adjoined rooms.

Nevertheless, despite the benefits and disadvantages of the above methods for floor plan reconfiguration, there have been several other attempts described in the prior art to provide disassemblable modular walls or partitions to facilitate the reconfiguration of office spaces. These, however, generally disclose structures and methods for interconnecting a plurality of partition units to create separately walled-in structures such as office cubicles or "turkey pens". For example, Robertson (U.S. Pat. No. 2,958,403) teaches a demountable partition adapted primarily for erection in an existing room to enclose a sub area of a given room.. A plurality of upright studs are arranged, in spaced, substantially parallel relationship and a plurality of wall board panels are attached to the studs in abutting edge-to-edge relationship thereto to define one or more walls of the partitioned subarea.

Similarly, Guarino et al. (U.S. Pat. No. 3,922,830) teach adjustable partition modules having at least three layers of internal fire resistant and sound deadening material, vertical adjusting means, and means for interconnection of adjacent modules requiring minimal installation hardware.

Still another partition is described by Hell (U.S. Pat. No. 4,192,106) who teaches modular elements used not only for creating disassemblable walls or cabinets, but also for erecting writing tables and other pieces of furniture. Hell generally comprises wall panels having on each longitudinal edge, box-like metal sections which coact with columnar interconnection devices to provide a means for connection of the wall panels.

A further modification of the general office cubicle concept is disclosed in Kissinger (U.S. Pat. No. 5,125,202) who teaches slidable privacy panels installable within a discrete wall panel to provide alternatively open or closed, private work stations.

Another line of references discloses closet-like enclosures such as the wall mounted closet described in Magnuson et al. (U.S. Pat. No. 3,433,549) who teach a unit comprising a pair of side panels and a set of shelves which are supported on wall-mounted brackets. However, the structure of Magnuson et al. in requiring all of the components to be separately mounted to the wall, makes the Magnuson closet unit incompatible with attachment to existing doorframes.

Still other references address the desire for sound deadening closet-like enclosures. For example, Judelson (U.S. Pat. No. 1,857,913) and Rosendale (U.S. Pat. No. 2,280,543) each teach cabinets or booths, such as telephone booths, which comprise separate, compact parts capable of quick and easy assembly. More recently, Eckel (U.S. Pat. No. 5,210,984) teaches a similarly easily assembled, sound deadening audiometric booth made from modular acoustic panels.

From the foregoing, it is readily apparent that while office cubicle units, modular booths, closets and the like are well known, none of the cited references either teach or even suggest means and methods of creating and installing a modular closet-type doorway unit to semi-permanently close off undesired door openings in a way to create independent, secure and discrete rental spaces within a master floor plan containing a plurality of interconnected office rooms.

Therefore a need still exists for means and methods to simply, quickly, easily, economically and securely close off existing doorways to subdivide larger rental spaces into a plurality of discrete secured smaller rental spaces and at the same time, allow those smaller spaces to be readily converted back to undivided, larger spaces. It is toward the satisfaction of these needs that the present invention is directed.

BRIEF SUMMARY OF THE INVENTION

The present invention is based upon a unique design of modular closure units which involves the use of a detachably attachable closet-type doorway closure unit having three interconnected walls with an integrally attached top member. A unit of the present invention is securely, yet detachably attachable to an existing doorframe by the means of two discrete sets of screws or like fasteners attached one set each on opposite sides of the unit. Thus, the unilateral removal of the unit by persons having access to only one side thereof is prevented and each newly-defined space is free from unknown or unwanted intrusion into that space.

The closure unit hereof is installed in its desired position by first removing the molding from one side of a doorframe. Preferably, the molding to be removed will be from the side of the frame opposite the door hinges. The closure unit may then be set against the exposed doorframe and attached thereto. The two sets of screws are disposed at an angle relative to the planar surfaces of the unit side walls and top cover. One set of screws is secured to the doorframe from the interior of the unit and the other from the exterior. Spackling may then be applied to cover the screw heads to effect a smooth, gapless finish.

Accordingly, a principal object of the present invention is to provide means and methods to alternately subdivide and enlarge multi-room floor plans by detachably attaching one or more modular closet-type doorway closure units to pre-existing doorframes.

Another object of the present invention is to completely, yet removably, close off an existing doorway by employing two discrete sets of screws or like fasteners, one set each applied on each side of a closure unit, to detachably secure the closure unit to a doorframe while preventing the unilateral removal therefrom.

These and still further objects as shall hereinafter appear are readily fulfilled by the present invention in a remarkably unexpected manner as will be readily discerned from the following detailed description of an exemplary embodiment thereof especially when read in conjunction with the accompanying drawings in which like parts bear like numerals throughout the several views.

DESCRIPTION OF THE PREFERRED EMBODIMENT

Figure 1:
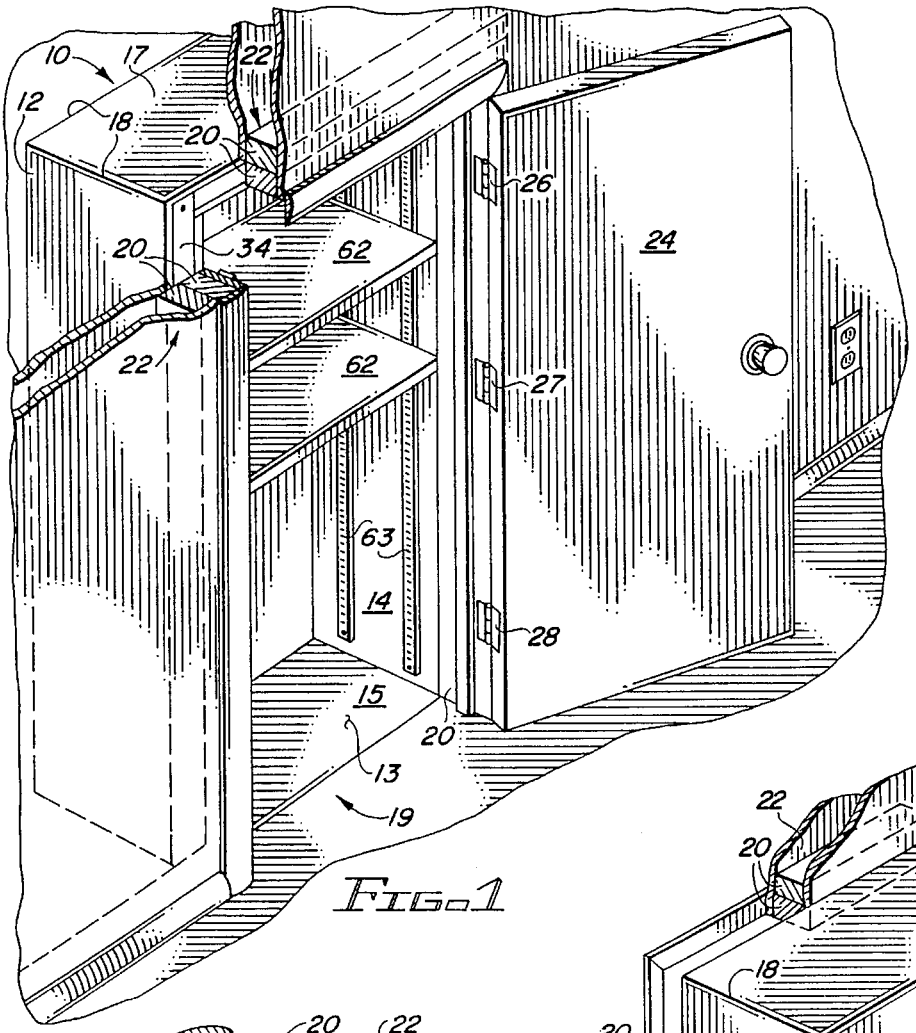
FIG. 1 is an isometric view of a modular doorway closure unit embodying the present invention as attached to an existing doorframe.

The present invention relates generally to a modular doorway closure unit and more particularly to a modular closet-type doorway closure unit which is detachably mountable in a doorway or other opening to secure that opening. The unit embodying the present invention is shown in the attached drawings and is identified by the general reference numeral 10.

Figure 2:
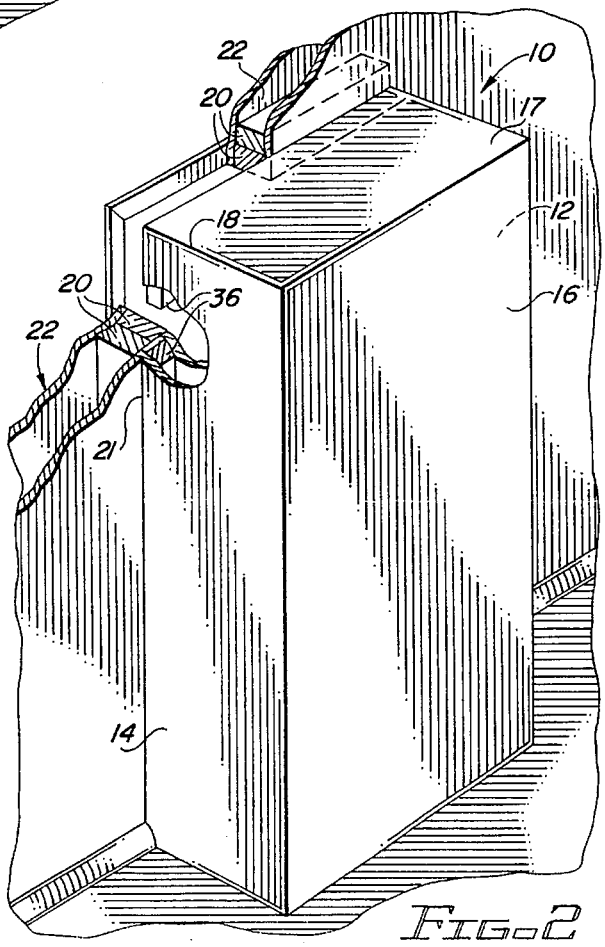
FIG. 2 is an isometric view of the obverse side of the modular doorway closure unit of FIG. 1 as attached to a doorframe.

As shown in FIGS. 1 and 2, modular closure unit 10 comprises three interconnected vertical walls, namely first side wall 12, second side wall 14, and back wall 16. Side walls 12, 14 are disposed in spaced generally parallel relationship to each other and are interconnected by back wall 16 which extends generally orthogonally therebetween. Unit 10 also has a top member 17 which is disposed upon and is integrally connected to side walls 12, 14 and back wall 16 along coplanar top edges 18. Optionally, member 17 may be inset between the inner surfaces of walls 12, 14, 16 such that the upper surface of member 17 is either coplanar with or disposed below edges 18.

Figure 3:
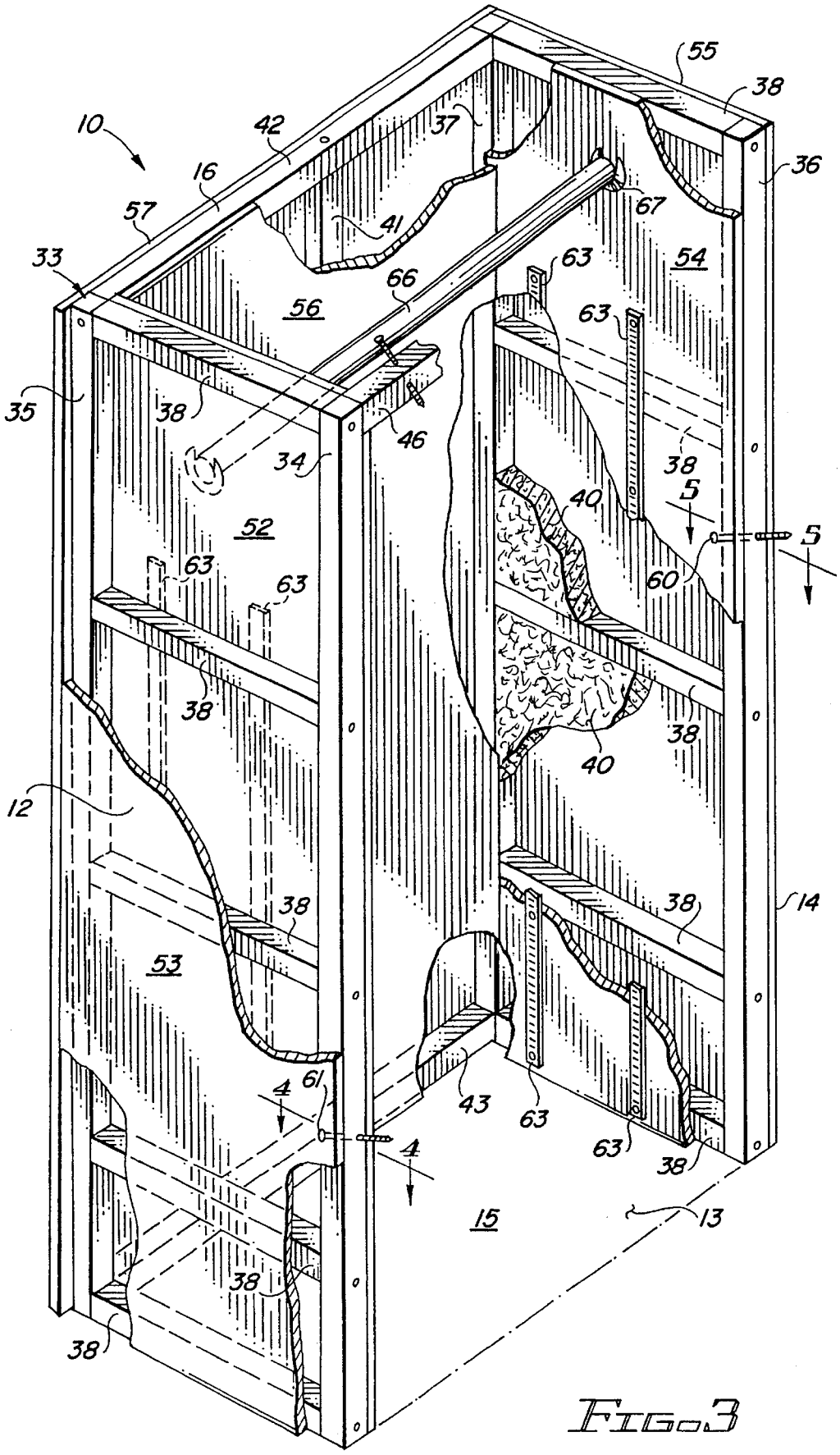
FIG. 3 is a partially fragmented isometric view of a modular doorway closure unit.

In the preferred embodiment as shown in FIGS. 1–3, unit 10 generally comprises an elongated hollow polyhedron having an open face 13 and an open base 15 interposed between side walls 12, 14. Though a right angular unit is described and preferred, other configurations are foreseeably within the scope of this invention so long as the sidewalls and top member are deliberately spaced from each other sufficiently to permit unit 10 to conform to and ultimately close off an open doorway 19.

As shown in FIG. 1, doorframe 20 defines doorway 19 and is the structure to which unit 10 is attached. Doorframe 20 is located in and conventionally secured to wall 22. Wall 22 is of any conventional type used to separate various rooms within a conventional building. Thus, wall 22 may be comprised of studs and dry wall or concrete blocks or other suitable materials. Doorframe 20 is preferably made of wood and can be used with any of the above described walls, however other materials could also be used for doorframe 20.

As shown, a standard door 24 is attached to doorframe 20 by means of upper, middle and lower hinges 26, 27 and 28 respectively. Another door structure (not shown) with which the present invention is equally useful is the sliding or so-called "pocket door". A conventional pocket door is opened by sliding it into a recess or pocket defined in the wall itself. Thus, with no exposed hinges, unit 10 may simply be attached to either side of door frame 20.

FIG. 1 shows one view of unit 10 as attached to doorframe 20. FIG. 2 shows the obverse view of the same unit 10 as attached. Note that unit 10 is attached to edge 21 of doorframe 20, that is, the edge opposite to the edge on which door 24 is attached. The unique procedure for mounting unit 10 is described in more detail below.

In the embodiment shown in FIGS. 1 and 2, unit 10 can be installed on doorframe 20 without removing door 24 and in such case, door 24 can be used to alternately expose or close off the interior space of unit 10 from the rest of the room which it serves. Thus, when the installation is complete, unit 10 may serve as a storage closet. Further details relating to various uses of unit 10 are described below.

One manner of outfitting unit 10 is shown in FIG. 3. As previously described, unit 10 comprises the assembly of side walls 12, 14, back wall 16 and top member 17. Walls 12, 14 and 16 and top member 17 are preferably made of wood or other framing materials covered with dry wall or other suitable construction materials which are either integrally formed or otherwise nailed, screwed, glued or otherwise fastened together.

In one embodiment of the present invention, a skeletal frame 33 is formed from at least four vertical frame members 34, 35, 36 and 37 as shown in FIG. 3. First and second vertical frame members 34 and 35 coact to define first side wall 12. Similarly, third and fourth frame members 36 and 37 define second side wall 14. In this embodiment, frame members 35 and 37 also define backwall 16. During installation, frame members 34 and 36 will be brought into surface-to-surface engagement with the vertical portions of doorframe 20 as will be hereafter described in detail. Skeletal frame 33 also includes one or more optional lateral support members 38 in each side wall 12, 14 as shown in FIG. 3. Lateral frame members 38 are nailed to or otherwise secured to either of vertical frame members 32 or 34 and extend therefrom to back wall 16 where they are secured to rear vertical frame members 35 or 37. A plurality of lateral support frame members 38 may be mounted in spaced, generally parallel relationship to each other as desired at various heights within both side walls 12 and 14. Thus frame members 38, when so spaced, provide additional support to skeletal frame 33 and/or may be used as members to which shelf support brackets (described below) and the like may be securely attached.

Insulative pieces 40 are disposed in the interstitial spaces between the several skeletal frame members of the entire unit 10 as shown for example between members 36, 37, and 38 in side wall 14 in FIG. 3. Insulative pieces 40 are of commercially available types, often sold in rolls or sheets so that the individual pieces may be cut to desired sizes. Further, insulative pieces 40 are preferably of a type that deadens sound. As used herein, "interstitial spaces" refer to the spaces defined between adjacent vertical and lateral support members.

FIG. 3 shows more skeletal frame members such as a vertical support frame member 41 interposed between lateral frame members 42 and 43 in back wall 16. Lateral frame members 42 and 43 extend between and are connected to back side vertical frame members 35 and 37 in back wall 16. Additional insulative pieces (not shown) are similarly mounted in the interstitial spaces formed in back wall 16.

One last frame member which is partially shown in this embodiment is lateral member 46 which extends between and is connected to the top portions of vertical frame members 34 and 36. Member 46 coacts with the other frame members to form top member 17 and is situated to support dry wall portions (as described below) as well as for attaching unit 10 to doorframe 20.

Continuing to refer to FIG. 3, skeletal frame 33 is covered with a plurality of dry wall members in the following manner. First side wall 12 has interior and exterior dry wall members 52 and 53 attached primarily to vertical frame member 34 and support members 38. In similar fashion, inner and outer dry wall portions 54 and 55 are attached to vertical frame member 36 and support members 38 of second side wall 14. Other drywall portions including inner back portion 56, outer back portion 57, and inner and outer top portions (not shown) are similarly attached to other corresponding skeletal frame members. Specifically, inner and outer back portions 56 and 57 are attached to frame members 41, 42 and 43, and both inner and outer top portions (not shown) are secured to frame members 42, 46 and the topmost lateral support members 38. All of these interior and exterior dry wall portions are preferably of a type that contribute to fire retardancy by meeting applicable building and fire codes. An example is R-3501 WALLBOARD that is Underwriters Laboratories (UL) listed TYPE FSW, ISSUE NO. C-6033.

In one practice of the present invention, unit 10 is formed by constructing a singular skeletal frame 33 to which are then attached the respective exterior dry wall portions. In the preferred embodiment, nails or screws are used to attach these portions to skeletal frame 33, although other known methods of securing such members may also be used. Next, when desired, insulative pieces 40 are mounted into the several skeletal interstices by attachment to the adjacent exterior dry wall surface. Next, the interior dry wall portions are attached to the appropriate frame members to then completely enclose or "sandwich" all of the insulative pieces 40 within the resulting walls 12, 14, 16 and top member 17. Preferably, all of the dry wall portions will be both sound deadening and fire retardant in so much as is practicable so that unit 10 will at least have all the conventional properties of and therefore function as a standard wall. It is of course understood that the reference to "dry wall" throughout this description is intended only to illustrate a commercially viable panel material and that other materials including wood, heavy duty plastic, fabricated wood and other non-plasterboard materials may be employed to enclose or panel the skeletal frame without departing from the invention.

It may then be desirable to apply a decorative covering to the interior and exterior walls and top member. Paint, wallpaper, or textured coatings such as stucco are among the many possible alternatives envisioned for use with the present invention.

Note, a plurality of units such as unit 10 may be made to conform in size to standard doorframe sizes, or alternatively, a unit 10 can also be made in any operable size to match any existing doorframe. Unit 10 can further be made in a plurality of shapes and need not be limited to perpendicularly oriented walls, which however, are most commonplace.

Alternatively, another embodiment of the present invention entails the use of interchangeable walls 12, 14 and 16 and top members 17 of different sizes so that disassemblable units 10 of different sizes can be assembled to conform to a plurality of doorframe sizes. Thus, there would be no singular skeletal frame 33 as described above. Rather, each wall and top member would be a separately enclosed entity which is detachably attachable to a plurality of other walls and top members to create units 10 of multiple sizes in the general shapes described above. Specifically, each wall 12, 14, 16 preferably has its own wooden frame filled with insulation and is covered with dry wall or other materials as above. Then, however these individual walls may be connected to each other and likewise have a similarly formed top member 17 attached thereto to form a plurality of variously sized disassemblable units 10 to be installed as described below.

When assembled as described, unit 10 is ready for installation on a doorframe 20. Unit 10 is first moved into the installation position as shown in FIGS. 1 and 2. Preferably, a thin glide board (not shown) is placed under unit 10 at this point and removed when installation is complete. This has the desired effect of reducing the impact of unit 10 on the existing carpeting and thereby reducing the potential need for re-carpeting the room upon removal of unit 10 from doorframe 20.

Figure 4:
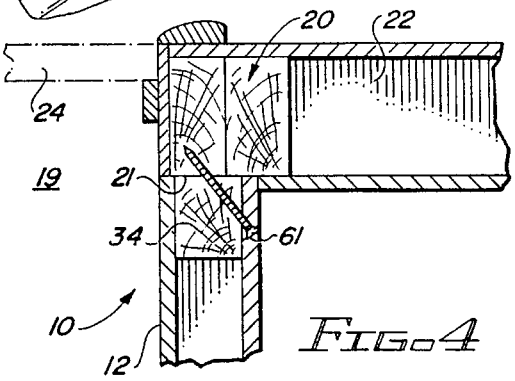
FIG. 4 is a cross-sectional view of the closure unit shown in FIG. 3 taken on line 4—4.
Figure 5:
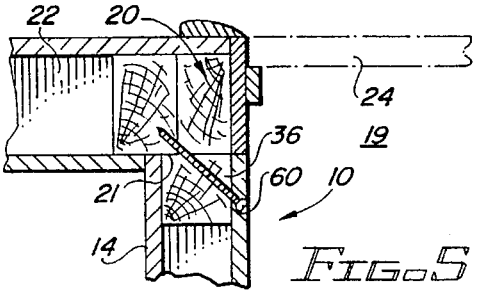
FIG. 5 is a cross-sectional view of the closure unit shown in FIG. 3 taken on line 5—5.

In the preferred embodiment as shown in FIGS. 3, 4, and 5, a set of a plurality of interior screws 60 are used in conjunction with a plurality of exterior screws 61 to secure the unit to a doorframe 20 from both sides thereof. Sample screws 60 and 61 in each sidewall 12, 14 and a screw 61 in top member 17 are shown in FIG. 3, while cross-sections of two sample screws are shown in FIGS. 4 and 5. Preferably, screws 60 and 61 are inserted in corresponding countersunk mounting holes which are pre-drilled through skeletal frame members 34, 36, and 46 and corresponding dry wall portions. Upon the application of the appropriate force, each set of screws 60 and 61 extends through unit 10 and becomes securely embedded in doorframe 20. Both sets of screws 60, 61 and their corresponding mounting holes are preferably set at lateral angles relative to the vertical planes of each of the first and second side walls in which they are installed. Likewise, when inserted in top member 17, screws 60 and 61 are also angled from the substantially horizontal plane coincident with top member 17. Angles not limited to, but approximately between 20 and 70 degrees have been found desirable. As previously described, screw sets 60 and 61 coact with unit 10 to provide security from the possibility that a party with access to only one of the rooms separated by unit 10 can gain access to the other side of wall 22 by removal of the singular set of screws accessible by that party.

To complete the installation, a common spackling compound (not shown) may be applied to cover the heads of screws 60 and 61. Any conventional compound may be used to cover the openings but preferably it will match the exterior and interior surface finishings of unit 10.

In another practice of the present invention, an installed unit 10 can perform as a closet. Specifically, a plurality of shelves 62 may be mounted at various locations within unit 10. For example, FIG. 1 shows the use of two shelves 62 which in this embodiment are thin, flat members that are as long as the interior of unit 10 is wide. Standard brackets 63 having a plurality of mounting holes covering the extent of the length of brackets 63 are shown attached to the interiors of side walls 12 and 14. Removable shelves 62 are mounted on conventional shelf mounts (not shown) which are demountably inserted in selected mounting holes as is conventionally known. Other known shelf embodiments could similarly be used herein. For example, brackets may be mounted vertically along the interior of back wall 16 to support shelves therefrom. Either way, greater support for brackets 63 may be obtained by attaching them to side walls 12 and 14 (or back wall 16) at specific predetermined locations where lateral support members 38 have been installed. More specifically, brackets 63 are more securely attachable to walls 12 and 14 if they are fastened through interior dry wall portions 52 and 54 and secured to lateral support members 38.

Another closet-type embodiment, as shown in FIG. 3, involves installing a cylindrical pole 66 in conventional pole holders 67. Pole 66 can be of any desired size and shape normally used for suspending other objects therefrom, such as clothes hangers and the like.

Detachment of unit 10 from doorframe 20 is simply done by first removing the spackling from the countersunk screw holes and then removing both sets of screws 60 and 61. Thereafter, if unit 10 is not to be immediately used to close off another doorway of similar size, unit 10 is either moved off-site for storage or alternatively, placed against a wall 22 such that rear wall 16 is juxtaposed against wall 22 and open face 13 is exposed to the room. Molding strips (not shown) such as those used on standard door frames, may then be attached to cover exposed skeletal frame members 34, 36, and 46 and spackle may be used to cover the open screw holes and any other surface anomalies such that unit 10 can be used as an open faced closet or bookcase.

Thus, a portable unit 10 has been described which performs all the functions of a solid wall (such as providing fire retardance and sound deadening), yet also allows for an inexpensive, quick, easy and clean alternative to the wall construction and deconstruction processes described above. In this way, units 10 of the present invention provide secure, eye-pleasing solutions to the subdivision and enlargement needs of commercial real estate leasing arrangements.

Figure 6:
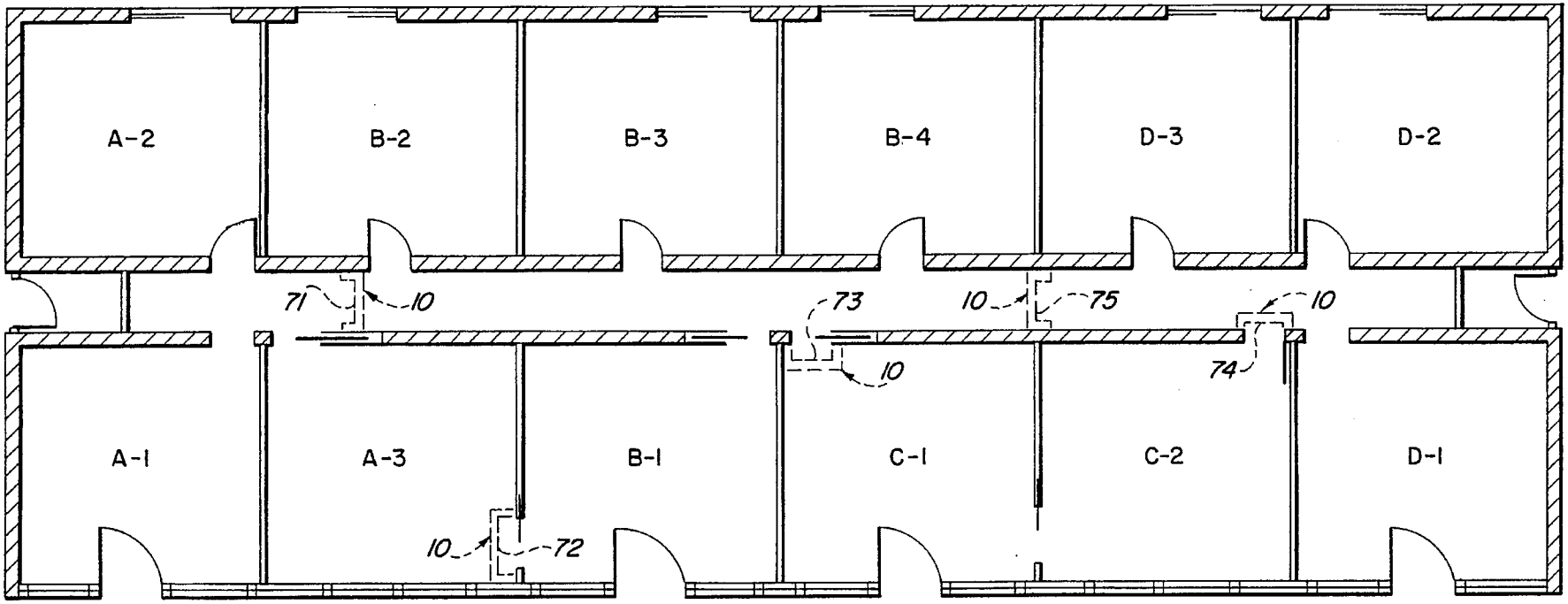
FIG. 6 is a typical floor plan in which the present invention may be used.

Referring now to FIG. 6 which shows a floor plan in which six modular doorway closure units 10 are used to create four sample rental spaces designated here using the letters A, B, C, and D. As will be seen, the six units 10 subdivide a large wholly interconnected floor plan into the four smaller rental spaces in which rental space A has three rooms denominated A-1 through A-3, rental space B has four rooms, B-1 through B-4, rental space C has two rooms, C-1 and C-2, and space D has three, D-1, D-2 and D-3.

The first specific usage of a unit 10 is shown in doorway 72 separating room A-3 from room B-1. Also separating rental space A from space B is a unit 10 used in the hallway at 71 to separate the hallway near room B-2 from the hallway in space A. Alternatively, a standard removable hallway divider (not shown) may be used to complete the subdivision of spaces A and B.

Note that the hallway unit 10 at 71 may be a custom sized unit 10 to close off the hallway between spaces A and B. Such a closure could be achieved by attaching a unit 10 to an existing doorframe in the hall if there indeed is such a doorframe, or it could be attached to the hall walls using a variation of the angularly set screws described above. Specifically, one set of screws may be angularly driven through frame members 34 and 36 into the hall walls and similarly another set of screws may be driven from the other side of unit 10 through frame members 35 and 37 into the hall walls to secure unit 10 from unilateral removal by a party on either side of unit 10.

Similarly, a unit 10 used in doorway 73 separates space C from B, while doorway 74, when closed off by another unit 10, completes subdivision of space D from C. Lastly, one more unit 10 located in the hallway at 75 separates rental space D from space C. Conventional hall dividers (not shown) (as alternatives to units 10 as described above) may also be used to complete the floor plan subdivision shown in FIG. 6. Again, this is merely an exemplar of the myriad possible floor plans that could be created by using one or more modular doorway closure units 10 of the present invention.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly what is claimed is:

1. A modular closure unit for use with a passageway defined by a frame in which said passageway is interposed between two adjacent floored rooms, said modular closure unit being operable to reversibly prevent passage between said rooms through said frame, said unit comprising: a first side wall; a second side wall disposed in spaced relationship to said first side wall; a back wall integrally connected to each of said side walls, each of said side walls and said back wall having an upper edge and a lower edge, said upper edges being disposed in coplanar relationship with each other to define an upper plane, said lower edges being in coplanar relationship with each other adjacent the floor disposed therebeneath; a top member integrally attached to said upper edges of said walls; and means for detachably securing each of said side walls to said frame to close said passageway and reversibly prevent passage between said adjacent rooms previously connected.

2. A modular unit according to claim 1 in which said securing means prevents said modular unit from being removed from said frame by a person having access to only one of said two adjacent rooms.

3. A modular unit according to claim 2 in which said securing means comprises two discrete sets of one or more screws, one of said sets attaching said unit to said frame from within one of said two adjacent rooms and the other of said sets attaching said unit to said frame from within the other of said two adjacent rooms.

4. A modular unit according to claim 3 in which said screws are disposed angularly relative to said frame.

5. A modular unit according to claim 1 in which each of said first and second side walls are disposed in substantially perpendicular relationship to said back wall.

6. A modular unit according to claim 5 in which said top member is attached to said upper edges of said first and second side walls and said back wall and defines a plane that is perpendicular to the planes of said first and second side walls and said back wall.

7. A modular unit according to claim 1 in which said modular unit is attachable to a doorframe in non-obstructive relationship to a door also connected to said doorframe.

8. A modular closure unit for semi-permanently closing off a doorway between adjacent rooms or for subdividing hallways which is detachably attachable to a doorframe which defines a doorway or to the walls which define a hallway, said modular closure unit comprising three walls integrally attached one on each side of the third wall; a top member integrally attached to each of said three walls and securing means for detachably attaching said modular closure unit to said doorframe or said walls to prevent said modular closure unit from being unilaterally removed from said doorframe or hallway by someone having access to only one side of said modular closure unit.

9. A modular closure unit according to claim 8 in which said securing means comprises two discrete sets of one or more screws, one of said sets attaching said unit to said doorframe or said walls from one side of said modular closure unit and the other of said sets attaching said unit to said doorframe or said walls from the other side of said modular closure unit.

10. A modular closure unit according to claim 9 in which each of said one or more screws is disposed angularly relative to said doorframe or said walls.

11. A modular closure unit according to claim 8 in which said third wall is a back wall and each of said other walls are integrally attached to said back wall on each side thereof in substantially perpendicular relationship thereto.

12. A modular closure unit according to claim 11 in which said top member is attached to said three walls so that the plane of said top member is substantially perpendicular to the planes of each of said three walls.

13. A modular closure unit according to claim 8 in which said modular closure unit is attachable to a doorframe in non-obstructive relationship to a door also connected to said doorframe.

14. A method for reversibly closing off an existing passageway defined by an existing building frame and interposed between two adjacent, finished floored rooms to prevent passage between said rooms, said method comprising the steps of:

(a) moving a finished modular closure unit into position about said passageway to completely yet reversibly close off said passageway, said finished modular closure unit having a first side wall, a second side wall disposed in spaced relationship to said first side wall, a back wall integrally connected to each of said side walls, each of said side walls and said back wall having an upper edge and a lower edge, said upper edges being disposed in coplanar relationship with each other to define an upper plane, said lower edges being in coplanar relationship with each other adjacent the floor disposed therebeneath, and a top member integrally attached to said upper edges of said walls; and (b) securing said finished modular closure unit to said existing building frame about said passageway by inserting two independent sets of securing devices through the first and second side walls of said finished modular closure unit so that each securing device becomes embedded in said existing building frame, one of said two independent sets of securing devices attaching said unit to said frame from within one of said two adjacent rooms and the other of said two independent sets of securing devices attaching said unit to said frame from within the other of said two adjacent rooms.

15. A method according to claim 14 in which each securing device is disposed angularly relative to said existing building frame.

16. A method according to claim 14 in which each of said first and second side walls are disposed in substantially perpendicular relationship to said back wall.

17. A method according to claim 14 in which said top member is attached to said upper edges of said first and second side walls and said back wall and defines a plane that is perpendicular to the planes of said first and second side walls and said back wall.

18. A method according to claim 14 which further comprises the step of leaving in place an operable door which was also attached to said existing building frame.

* * * * *